United States Patent [19]

Scofield

[11] Patent Number: 4,607,427

[45] Date of Patent: Aug. 26, 1986

[54] RUNNER COVERS

[75] Inventor: Hartzell D. Scofield, Highland, Ind.

[73] Assignee: Crisman Sand Company, Inc., Portage, Ind.

[21] Appl. No.: 733,106

[22] Filed: Jun. 13, 1985

Related U.S. Application Data

[63] Continuation of Ser. No. 579,818, Feb. 13, 1984, abandoned.

[51] Int. Cl.[4] ..... B23P 11/00

[52] U.S. Cl. ..... 29/432; 29/460; 266/196; 266/286; 52/227

[58] Field of Search ..... 266/280, 196, 287, 286, 266/45, 158; 52/227, 404; 29/432, 460

[56] References Cited

U.S. PATENT DOCUMENTS

| | | | |
|---|---|---|---|
| 3,854,262 | 12/1974 | Brady | 52/404 |
| 3,892,396 | 7/1975 | Monaghan | 266/286 |
| 3,990,203 | 11/1976 | Greaves | 52/227 |
| 4,300,753 | 11/1981 | LaBate | 266/196 |
| 4,355,788 | 10/1982 | LaBate | 266/196 |

*Primary Examiner*—L. Dewayne Rutledge
*Assistant Examiner*—S. Kastler
*Attorney, Agent, or Firm*—Richard G. Kinney

[57] ABSTRACT

A lightweight, warp-resistant cover for use on runners in steel mills which covers employs a steel exoskeleton on which an expanded metal walls are affixed. The cover is of an overall inverted U-channel shape to which layers of ceramic batting material are laid in planes at right angles to the walls of the cover and are affixed by means of L-shaped hangers attached to the metal mesh and its framework with impalers parallel to the expanded metal walls. The ceramic batting is impaled on the hangers and completely lines the interior of the cover and is preferably sealed by a final coating of ceramic insulation at its inner surface. A plurality of covers may be joined end-to-end to span the full length of a runner with any particular one being easily removable and replaced because of its lightweight. The construction covers are made by the process of forming a U-shaped channel rectilinear skeleton frame, welding expanded mesh walls to the frame, and affixing hangers at one end, with impalers pointed toward the other end. Rectangular layers of ceramic batting sized to span the back wall are then impaled thereon in layers perpendicular to the expanded metal wall until the impalers are covered and the additional hangers bolted to and through the expanded metal wall and repeating the impaling process until the entire interior surface is covered, and then coating the inner surface of the batting with ceramic insulating cement.

2 Claims, 9 Drawing Figures

RUNNER COVERS

This application is a continuation, of application Ser. No. 579,818, filed Feb. 13, 1984 now abandoned.

BACKGROUND OF THE INVENTION

1. Field Of The Invention

This invention relates to a new and improved cover and method of making such covers for molten metal and slag runners as are used in the steel and other industries for delivering molten metal from a source such as a blast furnace to a remote point.

2. Description Of The Prior Art

In steel-making, a blast furnace puts out molten metal together with slag floating atop it. This hot flowing material is caused to run down troughs, called "runners", some of which are for the combination and some of which are for slag separated from the metal and others of which are for the molten metal itself.

For many years, such runners were simply left open and gas, heat and particles were allowed to emit in large quantities into the atmosphere. Lately, however, in response to environmental concerns, governmental regulations, and a desire to conserve energy, some of these runners in some plants have been covered, usually as a retro-fit operation.

Various suggestions for covered runner systems are described in U.S. Pat. Nos. 4,355,788; 4,357,003; 4,300,753; and 4,354,668.

Those steel mills using covers have, however, run into problems among which is the tendency of the covers to warp, thus, opening gaps which release gas, heat and particles. Such prior art covers have tended to be expensive to make and use. Furthermore, the life of these covers has been relatively short, requiring frequent replacement with a resulting high cost.

Past commercial covers have used relatively heavy weight sheet metal backing into which a layer of ceramic insulating material (facing inward toward the molten metal and slag) is formed.

SUMMARY OF THE INVENTION

A runner cover may be constructed in accordance with the present invention by the steps of forming a rectilinear exoskeleton framework, providing walls of expanded metal to span the framework's members and welding in place; then, affixing hangars to the frame or the walls and impaling ceramic batting thereon, to form a runner cover whose entire interior surface is covered by ceramic batting; and, then, coating that interior surface with ceramic insulation and letting it dry.

An improved self-supporting runner cover constructed in accordance with the present invention is of a generally inverted channel-shape, with an interior lining of a thickness of ceramic batting which covers the interior of the cover and includes the improvement of a dried coating of ceramic insulating covering that surface.

ADVANTAGES OF THE INVENTION

While some nonload-bearing ceramic wall structures have been proposed for heat treating furnaces or kilns (e.g., U.S. Pat. No. 3,990,203), they use complex surrounding structures and hanger rods and have walls of insufficient strength and thickness to be self-supporting nor to deal with thermal shock and temperatures of above 2,500° F., such as are encountered with runner covers over molten steel and slag which are often at a temperature of 3,000° F. Further, these structures are complex and difficult to assemble in the environment of steel mill runners. As such, these structures, while possessing some advantages, have not been heretofore considered applicable to runner covers.

The present invention provides many of the advantages of such structures without the necessity of performing complex and difficult assembly in this environment. The result is an inexpensive, easily replaced cover that reduces leaking by lessening thermal warping.

The invention, together with the advantages thereof, may best be understood by reference to the following description taken in connection with the accompanying drawings, in the several figures of which like reference numerals identify like elements.

DESCRIPTION OF THE PREFERRED EMBODIMENT

Figure 1:
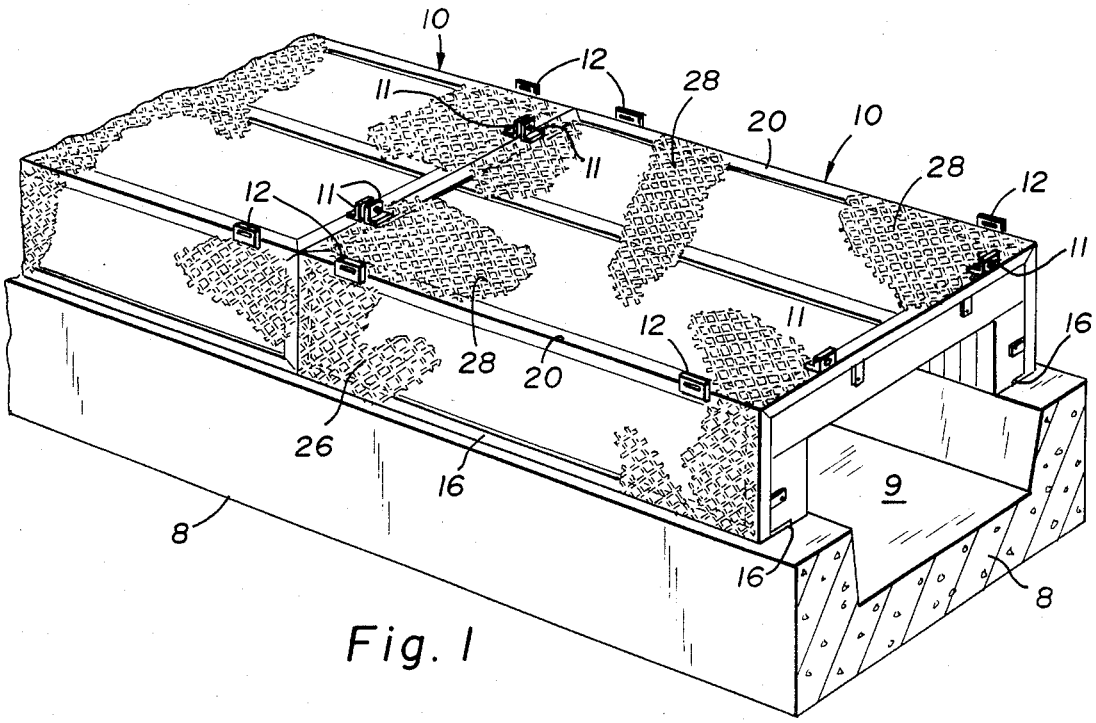
FIG. 1 is a perspective view of a portion of a runner shown partly in section, together with runner covers constructed in accordance with the present invention.

Referring to FIG. 1, there is depicted a hot metal runner 8 together with novel runner covers 10 constructed in accordance with the present invention. The covers 10 are shown in their operational position atop runner 8. The runner 8 defines a trough 9 through which molten metal, or slag, or both, may flow during e.g., discharge from a blast furnace. Such material may be as hot as 3,000 degrees F. in the case of a steel mill and the passage of such material under the covers 10 subjects them to relatively rapid rises and falls in temperature with the resulting thermal shock and stress.

The covers 10 are modularly made in convient sizes and, as shown in FIG. 1, capable of edge-to-edge alignment to cover the entire length of a runner 8. Overall, the covers 10 serve to retain heat, gases and particals from escaping into the ambient atmosphere. The covers 10 include a set of connection tabs 11 by which they may be bolted together. The covers 10 also include a set of lift tabs 12 by which they can be conveniently lifted and moved into place (e.g., by a fork-lift truck equipted with suitable mating hooks). The cover 10 is relatively lightweight compared to prior covers and, thus, can be more easily handled for set-up and replacement. And since it fits onto the conventional runner 8, it lends to retrofitting of existing open runner blast furnaces.

Figure 2:
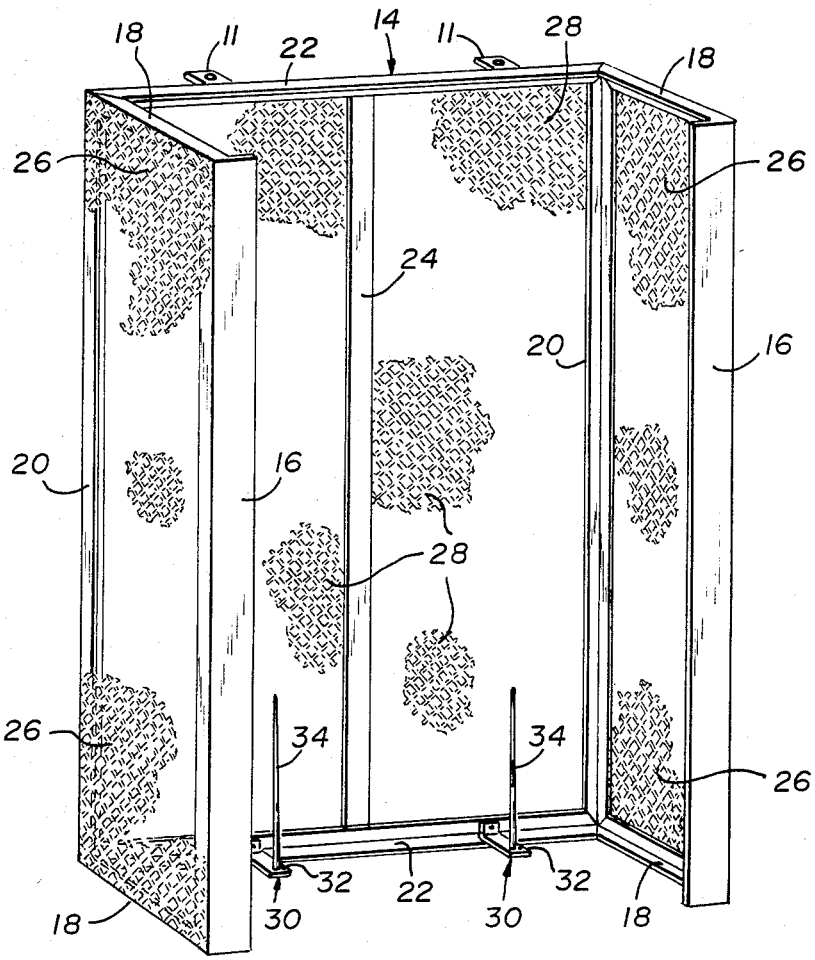
FIG. 2 is a perspective view of the exoskeleton framework of the runner covers of FIG. 1 at an early stage of its construction.

The construction of the runner covers 10 can best be understood by referring to FIGS. 2–7 which illustrate the various stages and steps in its manufacture. Referring now to FIG. 2, the first step is to provide, in accordance with the present invention, a load-bearing rectilinear exoskeleton framework 14 made up of elongated metal members, primarily steel angles. The exoskeleton 14 is made up of only nine members and is an exoskeleton in that it lies entirely at the outer surface of the cover 10. However, like the steel skeleton of a skyscraper, the exoskeleton 14 bears the major load of, and provides a rigid structure for the cover 10. The exoskeleton framework 14 includes a pair of base or foundation angle members 16 extending the length of the cover and providing the major surface upon which the cover 10 rests when on the runner 8 (FIG. 1). The members 16 have a short sidewall and have welded at their extreme ends, four end brace members 18, also of angle steel and forming a part of the framework 14. The frame work 14 further includes two corner angle members 20 extending the length of the cover 10 and welded at their extreme ends to the other ends of the braces 18 and also to the ends of a pair of cross braces 22 that span the width of the cover 10. A single longitudinal roof brace member 24 of a flat shape completes the exoskeleton 14. This brace 24 extends down the center of the top or roof surface of the cover 10 and is welded at the middle of the cross braces 22.

While specific dimensions and structure for the exoskeleton 14 will vary with the runner size and the equipment available, a prototype of the cover 10 was constructed for certain runners in one steel mill. Such prototype was about 54 inches wide, 20 inches high, and six feet long. In this case, the exoskeleton 14 was constructed of 1 inch by 1 inch by $\frac{1}{8}$ inch steel angles for the braces 18 and 22 and for the corner angles 20. The base angles 16 were made of 6 inch by 4 inch by $\frac{1}{8}$ inch steel and the brace 24 was made of 1 inch by $\frac{1}{8}$ inch steel plate.

Also in accordance with the present invention, expanded metal wall segments 26 and 28 are provide sized to preferably overlap onto the flat surfaces of the framework 14. After the framework 14 is assembled as shown in FIG. 2, the wall segments 26 and 28 are positioned in place and mig-welded along their entire periphery directly to the exoskeleton. This provides a high strength weld wherein the metal of the expanded meal segments 26 and 28 are actually fused to the framework 14. At this stage preformed tabs 11 and 12 may be conviently also welded in place. In the prototype discribed above, 12 gauge steel expanded metal was used having cross members of about $\frac{1}{8}$" and an opening of about $\frac{5}{8}$ by 1 and $\frac{1}{2}$ inches, opposite corner to corner.

As also shown in FIG. 2, L-shaped hangers 30 (e.g., those commercially available from Babcock & Wilcox model numbers 627-1 and 628-3) comprising a base 32 and impaler 34 are affixed initially to the framework at one cross brace 22 at about one-quarter and three-quarters of the width of the cover 10. The hangers 30 depicted in FIG. 2 are bolted to the framework and provide an impaler 34 parallel to the walls 38, which impaler extended, in the particular prototype referred to above, about 18 inches in length.

Figure 3:
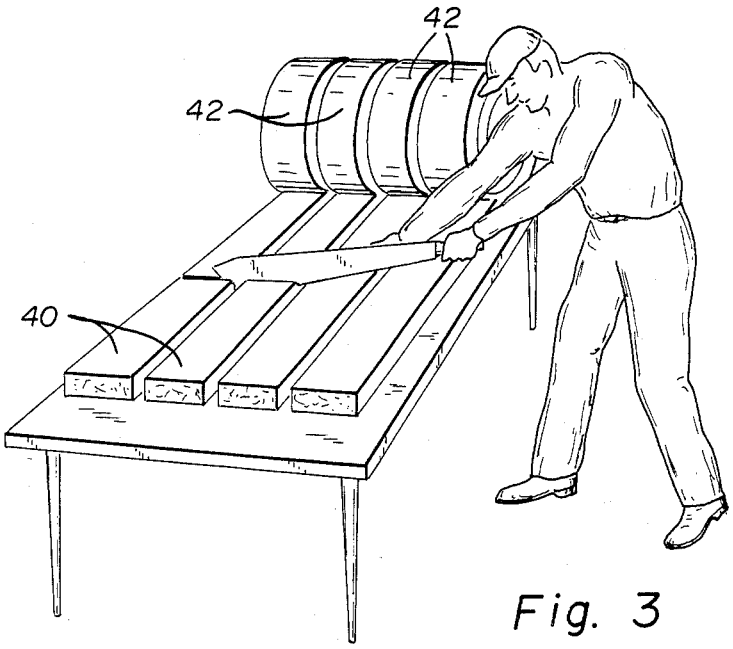
FIG. 3 is a perspective view of a workman cutting to size the ceramic batting for use in constructing the runner cover.
Figure 4:
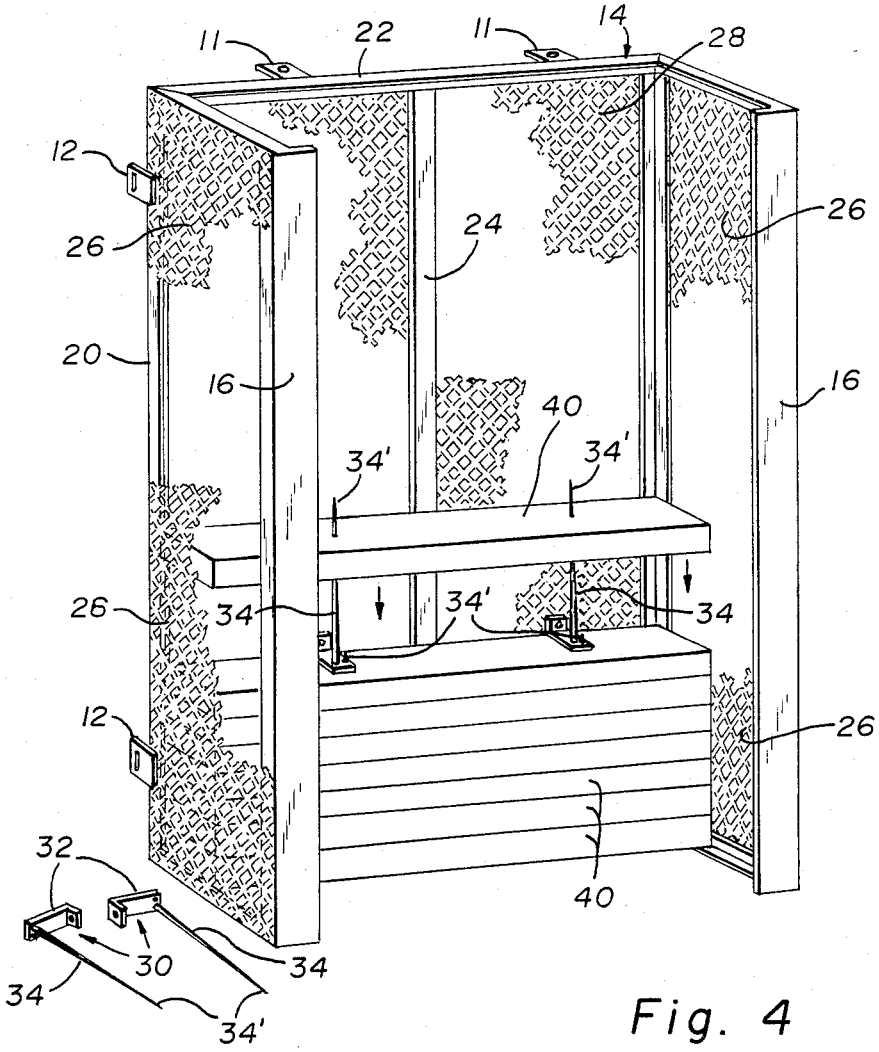
FIG. 4 is a perspective view similar to that of FIG. 2 at a later stage of construction, and illustrating the manner of placing the batting pieces of FIG. 3 thereon.

As shown in FIG. 3, ceramic fiber batting pieces 40, e.g., aluminasilicon fiber batting such as is currently commercially available under the trademark KAOWOOL, is provided of suitable width and length so as to span the interior dimension between the walls 26. This can be achieved simply by cutting off lengths 40 from rolls 42 which are commercially available of suitable width (e.g., 6 inches) and thickness (1 inch by 2 inch). These pieces 40 are impaled on the impalers 34 and compressed in layers as shown in FIG. 4. When a sufficient number of pieces 40 are impaled, a second set of hangers 30' are positioned (compressing the top layer pieces 40'). These hangers preferably have a mating hole in their base 32 to receive the tip 34' of the impaler 34 below and, thus, lock in the batting pieces 40.

Figure 5:
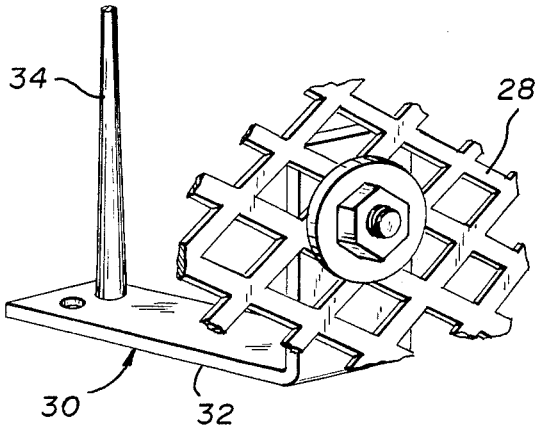
FIG. 5 is a detailed view of a portion of the runner cover of FIGS. 1 and 4 illustrating the manner of affixing certain parts thereof.

The second and successive set of hangers 30 are secured to the expanded metal by bolts, nuts, and washers as shwon in FIG. 5. The ability to so receive the hangers 30 is one of the advantages of using expanded metal walls.

The process of building up the roof or top is continued by impaling successive layers or pieces 40 as shown in FIG. 4. When the second set of impalers 34 is full, a third set is similarly secured atop them and filled with layers 40, and a fourth set atop them is similarly provided and affixed.

Figure 6:
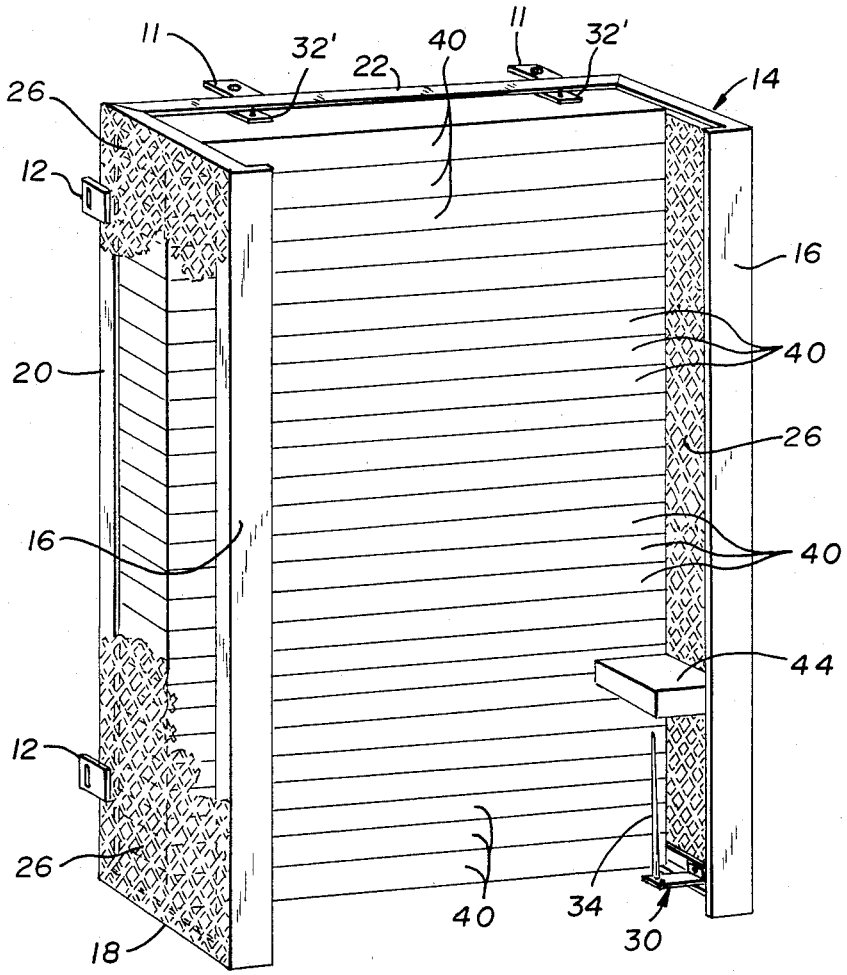
FIG. 6 is a perspective view similar to that of FIG. 4 showing the cover at a later stage of construction and illustrating the manner of insulating the interior side walls.

As shown in FIG. 6, base brackets 32' are bolted to brace 22 and serve to lock in the final set of pieces 40.

Figure 7:
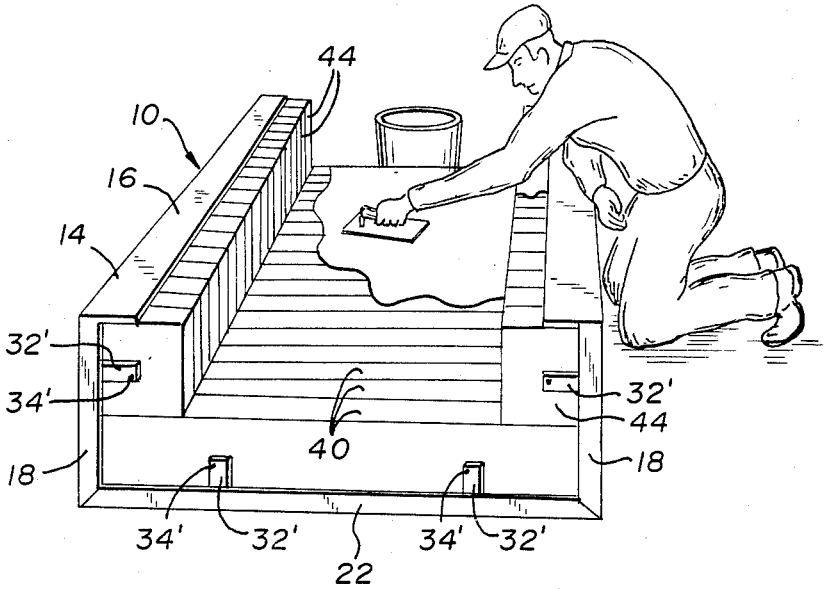
FIG. 7 is a perspective view of a workman applying a finishing coating of ceramic material to the interior of the runner cover.

Next, the process is repeated using smaller pieces 44 and a similar hanger 30 positioned along the interior side walls 26 as also shown in FIG. 6, and the final set of impalers similarly locked by braces 32' (FIG. 7).

The nearly complete cover is next turned on its back as shown in FIG. 7, and a layer of, e.g., liquid insulation, is applied as shown in FIG. 7. Such liquid insulation coating is available under the trademark UNIKOTE from Babcock & Wilcox. The result is cover 10 of FIG. 1.

Figure 8:
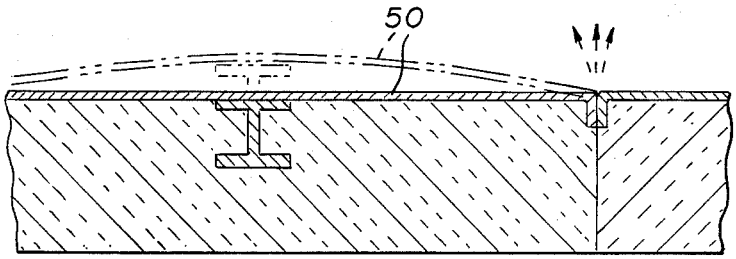
Fig. 8 PRIOR ART
FIG. 8 is a sectional view of a prior art cover illustrating its tendency to warp and leak under a heat load.

The cover 10 has a major advantage over existing runner covers such as that described and shown in U.S. Pat. No. 4,300,753 and others in commercial use, all of which employ metal sheet walls. As shown in FIG. 8, such walls 50 when subjected to heating and especially temperature gradiants caused by the transfer of heat from hangers 52 welded to the wall 50, warp or deform as indicated at the dashed lines, causing gaps 54 to develop, resulting in the loss of heat and the escape of gases and pullutants from the cover.

Figure 9:
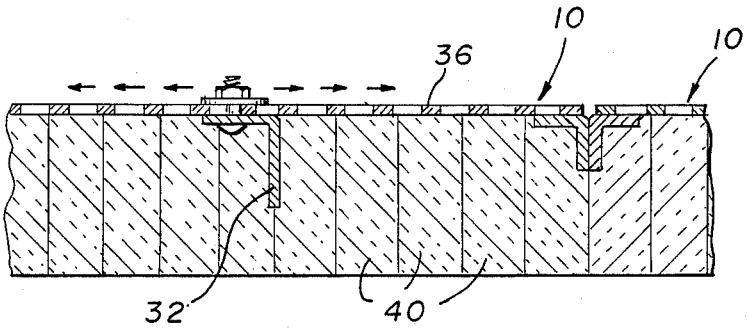
FIG. 9 is a sectional view of the runner cover of FIG. 1 under a heat load illustrating the different manner of reacting to the load.

As illustrated in FIG. 9, the expanded metal walls 36, because of the string-like nature of the expanded metal, tend to absorb expansion and contraction without overall warping of the cover. Also, because of the exposed high surface area to mass of expanded metal, the wall serves to radiate off heat more effectively and by allowing better air circulation around the expanded metal, dissipating heat better by convection. Thus, the walls 36 and 38 tend to maintain more uniform and even temperature, thus, decreasing thermal gradients in the walls. This means that the covers 10 tend to "warp" less in use and, thus, tend to open fewer gaps.

As should now be apparent, a runner cover has been described that has advantages over prior such covers in its ease of handling and maneuverability due to its lighter weight, less of a tendency to warp, open gaps, or lose heat and emit gases or pollutants, and is easily and economically constructed and used.

While one particular embodiment of the invention has been shown and described, it will be obvious to those skilled in the art that changes and modifications may be made without departing from the invention in its broader aspects and, therefore, the aim in the appended claims is to cover all such changes and modifications and fall within the true spirit and scope of the invention.

What is claimed is:

1. The process of making a selfsupporting portable unitary runner cover comprising the steps of, in sequence:

forming a rectilinear exoskeleton framework of linear steel members said framework providing rigidity and support to the cover;

providing walls of expanded metal sized to span between the steel members;

welding the expanded metal walls to the members about the wall peripheries;

affixing L-shaped hangars to the frame or walls and impaling ceramic batting thereon so as to form a thickness interior of such insulation over the entire interior of the runner cover; and applying a sealing coat of ceramic insulation to the interior and allowing it to dry.

2. The method of making a runner cover comprising the steps of, in sequence:

(a) forming a skeletal frame sized to cover a runner, in the shape of a U-crosssection channel and forming its walls substantially out of expanded metal said frame having a pair of oppositely disposed side walls and a top wall spanning between them;

(b) affixing L-shaped impaling hangers to the frame such that the impalers extend parallel to the top wall and one impaler extends parallel to the side walls, said impalers pointing toward one end of the frame;

(c) cutting ceramic batting into layered pieces sized to span across the top wall and impaled upon the impalers until the impaler has substantially received all, such that it can, and has, compressed them somewhat;

(d) installing additional hanger brackets by bolting them through and to the expanded metal, such that the bracket base secures in place the batting pieces of step (b) above;

(e) repeating step (c) above with regard to the additional hanger brackets and repeating step (d) above until the top wall is substantially covered by said impaled pieces of batting;

(f) repeating the process of steps (c), (d) and (e) above with regard to the side walls, resulting in a cover whose interior surface is entirely of ceramic batting; and (g) applying a sealing coat of ceramic insulation to the interior surface and allowing it to dry.

* * * * *